US005920294A

United States Patent [19]

Allen

[11] Patent Number: 5,920,294

[45] Date of Patent: Jul. 6, 1999

[54] TENSIONED CORD ATTACHMENT OF ANTENNA REFLECTOR TO INFLATED SUPPORT STRUCTURE

[75] Inventor: Bibb B. Allen, Palm Bay, Fla.

[73] Assignee: Harris Corporation, Melbourne, Fla.

[21] Appl. No.: 08/885,451

[22] Filed: Jun. 30, 1997

[51] Int. Cl.[6] ..... H01Q 1/38

[52] U.S. Cl. ..... 343/912; 343/914

[58] Field of Search ..... 343/912, 914

[56] References Cited

U.S. PATENT DOCUMENTS

| | | | |
|---|---|---|---|
| 2,814,038 | 11/1957 | Miller | 343/757 |
| 4,364,053 | 12/1982 | Hotine | 343/915 |
| 4,755,819 | 7/1988 | Bernasconi et al. | 343/915 |

*Primary Examiner*—Robert H. Kim
*Assistant Examiner*—Tu T. Nguyen
*Attorney, Agent, or Firm*—Charles E. Wands

[57] ABSTRACT

A collapsible conductive material includes a generally mesh-configured, collapsible surface, that defines the intended reflective geometry of an antenna, and a distribution of tensionable cords and ties, which attach the reflective mesh to an inflatable support structure. The antenna is fully deployed once the inflatable support structure is inflated to at least a minimum pressure necessary to place the attachment tie/cord arrangement in a tension that causes the reflective surface to acquire a prescribed (e.g., parabolic) geometry. Preferably, the inflation pressure is above the minimum value, so as to allow for pressure variations (drops) within the support structure.

19 Claims, 1 Drawing Sheet

TENSIONED CORD ATTACHMENT OF ANTENNA REFLECTOR TO INFLATED SUPPORT STRUCTURE

FIELD OF THE INVENTION

The present invention relates in general to antenna assemblies and is particularly directed to a new and improved antenna reflector support configuration that employs tensioned ties and cord attached to an inflated support structure, such that the shape of the antenna reflector is effectively insensitive to variations in pressure within the inflated support structure.

BACKGROUND OF THE INVENTION

Among the variety of antenna assemblies that have been proposed for airborne and spaceborne applications are those unfurlable structures which employ an inflatable membrane or laminate to form a 'stressed skin' type of reflective surface. In the configurations which have been proposed to date, non-limiting examples of which are described in U.S. Pat. Nos. 4,364,053 and 4,755,819, the surface of the inflatable structure itself serves as the reflective surface of the antenna. Namely, the inflatable material has a preformed geometry, so that, once fully inflated, its surface will assume the desired antenna geometry. A significant drawback to such structures, however, is the fact that should there be a change in inflation pressure, most notably a decrease in pressure over time, the contour of the support structure and therefore that of the reflective surface itself, will change from the intended antenna profile, thereby impairing the energy gathering and focussing properties of the antenna.

SUMMARY OF THE INVENTION

In accordance with the present invention, this problem is effectively solved by a hybrid antenna architecture that segregates the reflective geometry of the antenna's reflective surface from the contour of the inflatable support structure, while still using the support functionality of the inflatable structure to deploy the antenna. Rather than make the reflective surface geometry of the antenna depend upon the ability to continuously maintain the inflation pressure of the support structure at a value that realizes a desired inflated membrane geometry, the present invention merely employs the inflatable support structure as a deployable attachment surface, to which a collapsible tensioned cord arrangement for the antenna's refective surface is affixed.

As will be described, the antenna's reflective surface, which may be made of a collapsible material, such as one having a reflective mesh-configuration, defines the intended reflective geometry of the antenna, when held in place by a tensioned distribution of attachment cords and ties, that are used to attach the mesh to the inflatable support structure. The antenna is fully deployed once the inflatable support structure is inflated to at least the extent necessary to place the reflector's attachment tie and cord arrangement at their prescribed tensions. Preferably, the inflation pressure is above a minimum value, so as to allow for pressure variations (drops) within the support structure that do not allow the inflated support membrane to deform to such a degree as to relax or deform the reflector from its intended deployed geometry.

DETAILED DESCRIPTION

Figure 1:
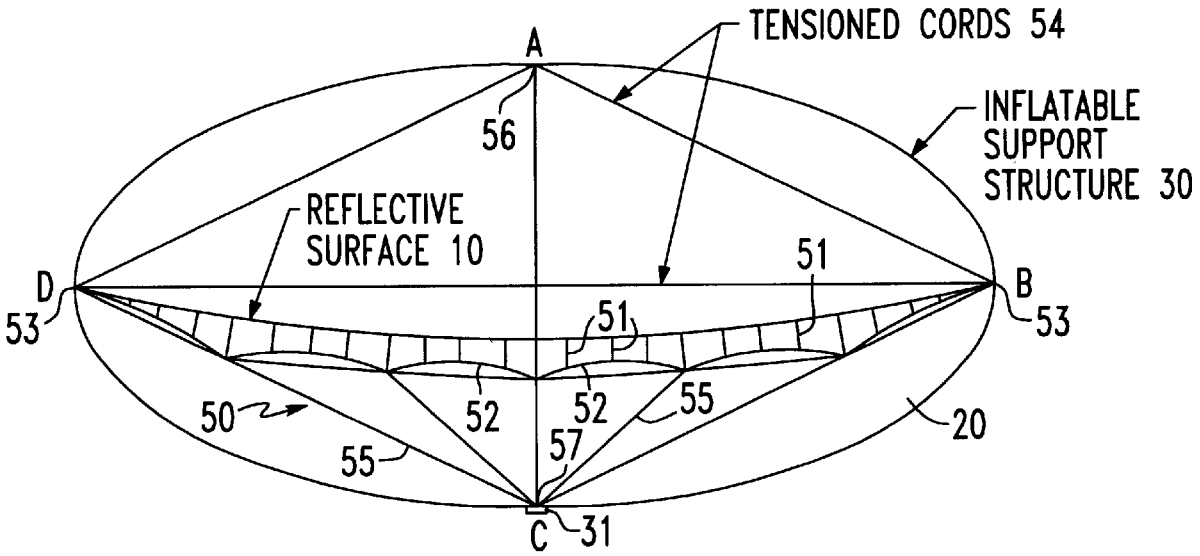
FIG. 1 diagrammatically illustrates a cross-section of a first, interior-supported embodiment of the hybrid antenna architecture of the present invention.

Attention is now directed to FIG. 1, which diagrammatically illustrates a cross-section of a first, 'interior-supported' embodiment of the hybrid antenna architecture of the present invention, taken through a plane that contains an axis of rotation AC, about which a collapsible, generally parabolic, reflective material 10, is rotationally symmetric, and such that the reflective material is supported within the interior inflatable volume 20 of a generally elliptical or spherical inflatable support membrane or structure (e.g., balloon) 30, which is also rotationally symmetric about axis AC.

For purposes of providing a non-limiting illustrative example, the reflective material 10 may be comprised of a relatively lightweight mesh, that readily reflects electromagnetic or solar energy, such as gold-plate molybdenum wire mesh. It may also employ other materials, such as one that it is highly thermally stable, for example, woven graphite fiber. The strands of the reflective mesh have a weave tow and pitch that are selected in accordance with the physical parameters of the antenna's deployed application. It should also be noted that the reflective surface may be used to reflect other forms of energy, such as, but not limited to, acoustic waves.

The inflatable support structure/membrane (or balloon) 30 may comprise an inflatable laminate structure of multiple layers of sturdy flexible material, that is effectively transparent to energy in the spectrum region of interest. For electromagnetic and solar energy applications, a material such as Mylar may be used. In the course of deployment, the inflatable balloon 30 may be inflated by way of an fluid inflation port 31 installed at a balloon surface region along axis AC, for example at either of points A or C, where the axis of rotation AC intersects the inflatable membrane 30. Alternatively, the balloon 30 may be filled with a material (such as mercuric oxide powder, as a non-limiting example) that readily sublimes into a pressurizing gas, filling the interior volume 20 of the balloon, and thereby causing the inflatable support structure 30 to expand from an initially furled or collapsed (stowed) state to the fully deployed state, shown in FIG. 1.

As described briefly above, the hybrid antenna architecture of the present invention is configured so as to effectively segregate the reflective geometry of the reflective surface 10 of the antenna from the contour of the inflatable support balloon 30, while still using the support functionality of the inflating membrane to deploy the antenna's reflective surface 10 to its intended (e.g., parabolic) geometry. For this purpose, the reflective material (e.g., reflective mesh) 10 is attached to an adjacent collapsible arrangement 50 of tensionable ties 51 and (catenary) cords 52 which, in turn, are connected (by way of an adhesive or sewn attachment elements) to a plurality of attachment points 53 distributed around the interior diameter of the balloon, and by way of tensionable cords 54 and 55 to respective tethering points 56 and 57, corresponding to the points A and C of axis AC. These tensionable ties and cords are preferably made of a lightweight, thermally stable material, such as woven graphite fiber.

As noted above, since each of the reflective (mesh) structure 10 and its associated attachment ties and cords 50 is collapsible, the entire antenna reflective surface and its associated tensioned attachment structure is readily furlable within the inflatable membrane 30 in its non-deployed, stowed state, yet readily unfurls into a predetermined geometry, highly stable reflector structure, once the encapsulating support balloon 30 becomes inflated. In this regard, it is preferred that the antenna support structure/membrane 30 be inflated to a pressure that is greater than necessary to place the cord and tie arrangement 50 in tension and cause the reflector structure (mesh) 10 to acquire its intended geometry.

Such an elevated pressure will not only maintain the support membrane 30 inflated, but will accommodate pressure variations (drops) therein, that do not permit the inflated support membrane to deform to such a degree as to relax the tension in the reflector's attachment ties and cords, whereby the antenna's reflective surface 10 will retain its intended deployed shape. An additional benefit of supporting the antenna's reflector surface 10 within or interior of the inflatable support structure 30 is the fact that the antenna is protected by the surrounding material of the balloon from the external environment.

Figure 2:
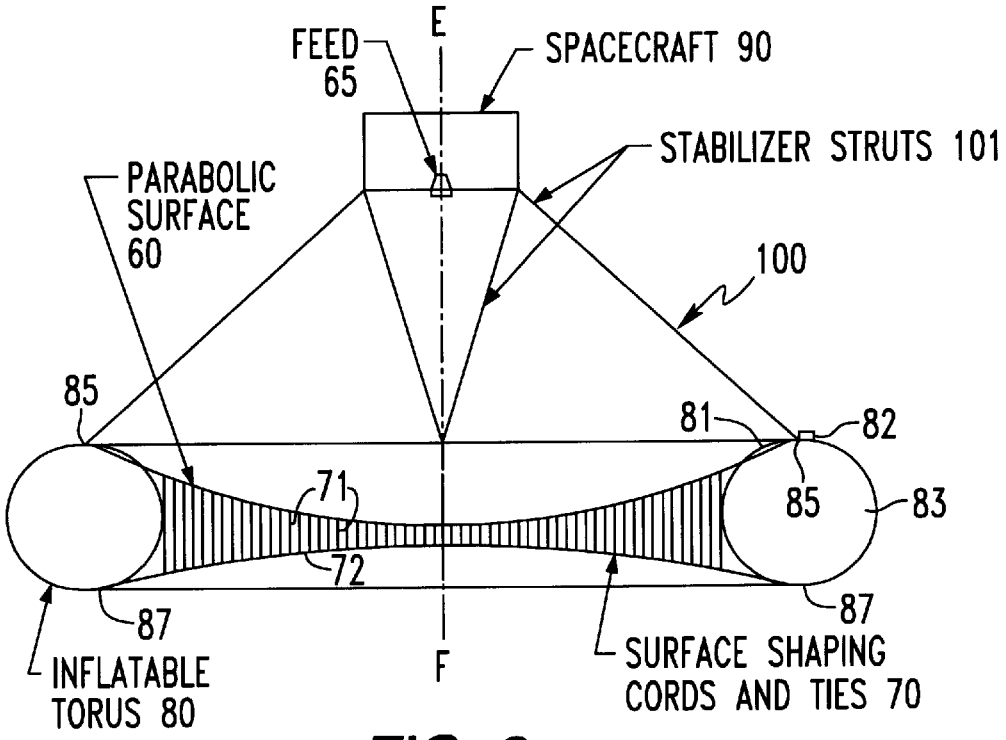
FIG. 2 diagrammatically illustrates a cross-section of a second, exterior-supported embodiment of the hybrid antenna architecture of the present invention.

FIG. 2 diagrammatically illustrates a cross-section of a second 'exterior-supported' embodiment of the hybrid antenna architecture of the present invention, taken through a plane that contains an axis of rotation EF, in which a generally parabolic reflective surface 60, such as a reflective mesh material, described above, or other energy-reflective material, is rotationally symmetric about axis EF, passing though an antenna feed horn 65. The reflective surface 60 is attached via a tensioned cord and tie arrangement 70 to the exterior surface 81 of a generally toroidal or torus-configured inflatable support structure 80, which is also rotationally symmetric about axis EF.

As in the embodiment of FIG. 1, the reflective material of the antenna's energy-reflective surface 60 may be comprised of a lightweight, reflective or electrically conductive and material, such as, but not limited to, gold-plated molybdenum wire or woven graphite fiber. In the embodiment of FIG. 2, the inflatable support structure 80 for the tie and cord arrangement 70 is shown as being attached to a support base 90 (such as a spacecraft) by way of a truss 100, that may be formed of relatively stiff stabilizer struts or rods 101, rotationally symmetric about axis EF.

Again, as in the first embodiment, the inflatable support balloon 80 may comprise an inflatable laminate of multiple layers of sturdy flexible material, such as Mylar. For purposes of deployment, the inflatable toroid 80 is inflatable by way of an inflation valve 82 located at a balloon surface region along its attachment to the truss 100, or it may be filled with a material that readily sublimes into a pressurizing gas, filling the interior volume 83 of the toroid 80.

Similar to the 'interior-supported' embodiment of FIG. 1, the 'exterior-supported' embodiment of FIG. 2 attaches the (mesh) reflector surface 60 to the support structure (here toroidally configured balloon 80) by means of the arrangement 70 of tensionable ties 71 and cords 72, which are connected to plural attachment points 85, 87, distributed around the exterior surface 81 of the inflated membrane 80. As in the first embodiment, the distribution or arrangement 70 of ties and cords is rotationally symmetric around axis EF and may be made of a lightweight, thermally stable material, having a low coefficient of thermal expansion, such as woven graphite fiber. For the reasons discussed above in connection with the first embodiment, it is preferred that the antenna's inflatable support structure 80 be inflated to a pressure that is greater than necessary to place the attachment cord and tie arrangement 50 in a prescribed tension at which the reflective surface 60 acquires its intended shape.

As will be appreciated from the foregoing description, the above discussed geometry dependency shortcoming of conventional inflated antenna structures is effectively remedied by the hybrid antenna architecture of the present invention, which essentially isolates or segregates the reflective surface of the antenna from the contour of the inflatable support structure, while still using the support functionality of the inflatable structure, as it is inflated, to deploy the antenna. Advantageously, the tensioned tie and cord arrangement maintains the desired geometry of the surface of the antenna, while allowing for pressure variations within the support structure.

While I have shown and described several embodiments in accordance with the present invention, it is to be understood that the same is not limited thereto but is susceptible to numerous changes and modifications as are known to a person skilled in the art, and I therefore do not wish to be limited to the details shown and described herein, but intend to cover all such changes and modifications as are obvious to one of ordinary skill in the art.

What is claimed:

1. An antenna comprising:

a material which provides a reflective surface for energy incident thereon; and an inflatable support structure to which said reflective material is attached by a tensionable attachment arrangement and, upon being inflated, places said tensionable attachment arrangement in tension and causes said reflective surface to acquire an intended reflective surface geometry; and wherein said tensionable attachment arrangement has a distribution of tensionable cords and ties, which attach said reflective surface material to said inflatable support structure, and which, when placed in tension by inflation of said inflatable support structure, cause said reflective surface material to acquire said intended reflective surface geometry.

2. An antenna according to claim 1, wherein said inflatable support structure is effectively transparent to said energy.

3. An antenna according to claim 1, wherein said reflective surface material comprises a collapsible reflective surface material that is supported by said tensionable attachment arrangement within an interior volume of said inflatable support structure, so that upon said inflatable support structure being inflated, tensioning of said tensionable attachment arrangement causes said reflective surface material to acquire said intended reflective surface geometry within said interior volume of said inflatable support structure.

4. An antenna according to claim 1, wherein said reflective surface material comprises a reflective mesh material.

5. An antenna according to claim 1, wherein said reflective surface material comprises a reflective mesh material.

6. An antenna, comprising:

a material which provides a reflective surface for energy incident thereon; and an inflatable support structure to which said reflective material is attached by a tensionable attachment arrangement and, upon being inflated, places said tensionable attachment arrangement in tension and causes said reflective surface to acquire an intended reflective surface geometry, and wherein said reflective surface material comprises a collapsible reflective surface material that is attached to an exterior surface of said inflatable support structure by said tensionable attachment arrangement, so that upon said inflatable support structure being inflated, tensioning of said tensionable attachment arrangement causes said reflective surface material to acquire said intended reflective surface geometry outside of the inflatable volume of said inflatable support structure.

7. An antenna according to claim 6, wherein said inflatable support structure has a generally toroid configuration.

8. A method of deploying an antenna comprising the steps:

(a) attaching to an inflatable support structure, by means of a tensionable connection arrangement, a collapsible reflective material which, when deployed, forms a reflective surface having an intended reflective surface geometry for energy incident thereon; and (b) inflating said inflatable support structure to at least an extent necessary to place said tensionable connection arrangement in tension and cause said reflective surface material to deploy and acquire said intended reflective surface geometry; and wherein said tensionable connection arrangement includes tensionable cords and ties, which attach said reflective surface material to said inflatable support structure, and which are placed in tension when said inflatable support structure is inflated in step (b).

9. A method according to claim 8, wherein said inflatable support structure contains material that is effectively transparent to said energy.

10. A method according to claim 8, wherein step (a) comprises attaching said tensionable connection arrangement to an interior surface of said inflatable support structure, so that upon said inflatable support structure being inflated in step (b), said reflective surface material is deployed by said tensionable connection arrangement being placed in tension and is thereby supported in said intended reflective surface geometry within an interior volume of said inflatable support structure.

11. A method according to claim 10, wherein said reflective surface material has a mesh configuration.

12. A method according to claim 8, wherein step (a) comprises attaching said reflective surface material by way of said tensionable connection arrangement to an exterior surface of said inflatable support structure, so that upon said inflatable support structure being inflated in step (b), said tensionable connection arrangement is placed in tension and thereby supports said reflective surface material outside of the interior inflatable volume of said inflatable support structure.

13. A method according to claim 12, wherein said inflatable support structure has a torus configuration.

14. A method according to claim 8, wherein said reflective surface material is generally mesh-configured.

15. An antenna comprising:

a collapsible reflective structure which, when deployed, conforms with a prescribed geometrical shape and is operative to reflect energy incident thereon;

an inflatable support structure; and a distribution of tensionable cords and ties which attach said collapsible reflective structure to said inflatable support structure, and which are placed in tension when said inflatable support structure is inflated, and cause said collapsible reflective structure to conform with said prescribed geometrical shape so as to reflect energy incident thereon.

16. An antenna according to claim 15, wherein said inflatable support structure is effectively transparent to said energy.

17. An antenna according to claim 15, wherein said collapsible reflective structure comprises generally mesh-configured material, which is attached to an interior surface of said inflatable support structure by means of said distribution of tensionable ties and cords, so that upon said inflatable support structure being inflated, said tensionable ties and cords are placed in tension and support said generally mesh-configured material in said prescribed geometrical shape within an interior volume of said inflatable support structure.

18. An antenna according to claim 15, wherein said collapsible reflective structure comprises generally mesh-configured material, which is attached to an exterior surface of said inflatable support structure by means of said distribution of tensionable ties and cords, so that, upon said inflatable support structure being inflated, said tensionable ties and cords are placed in tension and support said generally mesh-configured material in said prescribed geometrical shape outside an interior volume of said inflatable support structure.

19. An antenna according to claim 18, wherein said inflatable support structure has a torus configuration.

* * * * *